US011866928B2

(12) United States Patent
Deans

(10) Patent No.: US 11,866,928 B2
(45) Date of Patent: Jan. 9, 2024

(54) EAZY SUPPORTING HOLDING AND CLAMPING SYSTEM

(71) Applicant: Dannie Lew Deans, Vernal, UT (US)

(72) Inventor: Dannie Lew Deans, Vernal, UT (US)

( * ) Notice: Subject to any disclaimer, the term of this patent is extended or adjusted under 35 U.S.C. 154(b) by 173 days.

(21) Appl. No.: 16/700,290

(22) Filed: Dec. 2, 2019

(65) Prior Publication Data

US 2021/0062497 A1 Mar. 4, 2021

Related U.S. Application Data

(60) Provisional application No. 62/895,007, filed on Sep. 3, 2019.

(51) Int. Cl.

| | |
|---|---|
| ***B23K 37/04*** | (2006.01) |
| ***E04B 1/38*** | (2006.01) |
| ***E04B 2/72*** | (2006.01) |

(52) U.S. Cl.

CPC ..... *E04B 1/388* (2023.08); *E04B 2/723* (2013.01); *E04B 2001/389* (2023.08)

(58) Field of Classification Search

CPC ..... E04B 1/40; E04B 2001/405; E04B 2/723; B23K 37/04; B25B 5/10

USPC ..... 269/60, 172

See application file for complete search history.

(56) References Cited

U.S. PATENT DOCUMENTS

| | | | | |
|---|---|---|---|---|
| 1,554,468 | A * | 9/1925 | Tague | B60T 17/221 254/100 |
| 1,893,267 | A * | 1/1933 | Bickel | A63B 51/14 473/555 |
| 2,466,518 | A * | 4/1949 | Wagner | B25B 5/006 269/91 |
| 2,907,238 | A * | 10/1959 | White | B25B 1/22 269/76 |
| 5,826,310 | A * | 10/1998 | Hobday | B25B 5/068 24/514 |
| 9,702,139 | B2 * | 7/2017 | Espinosa | E04B 1/4121 |
| 10,556,326 | B1 * | 2/2020 | Kelly | B25B 1/103 |
| 2014/0145289 | A1 * | 5/2014 | Zhang | H01L 29/0619 257/475 |
| 2017/0130418 | A1 * | 5/2017 | Servais | E02D 35/00 |
| 2017/0291281 | A1 * | 10/2017 | Tsui | B25B 5/10 |
| 2018/0202143 | A1 * | 7/2018 | Vanker | E04F 11/022 |

* cited by examiner

*Primary Examiner* — William V Gilbert

(57) ABSTRACT

The present invention relates to a supporting, holding and clamping tool system and a method associated with the system. With respect to the system, it is a pair of devices and attachments designed to attach to a wall to support construction sheathing while securing it to the wall, which may also be used for a versatile clamping device.

This system can be used by one person to facilitate installing heavy sheets of sheet rock, Siding, plywood or other materials to be installed on the vertical wall or surface.

5 Claims, 20 Drawing Sheets

EAZY SUPPORTING HOLDING AND CLAMPING SYSTEM

CROSS-REFERENCES TO RELATED APPLICATIONS

This application is an improved version of a Provisional Patent U.S. 62/895,007.

FIELD OF THE INVENTION

The invention relates generally to versatile holding supporting and clamping System Which is designed to be marketed as a pair.

BACKGROUND

Currently there may be a number of solutions for when a person is working alone trying to install sheathing materials such as drywall which is typically made in sheet sizes of 4'×8', 4'×10', 4'×12' and thickness of ¼", ½" and ⅝", or plywood, OSB or siding which are typically 4'×8' sheets or long planks, which are very difficult for most individuals to lift, hold, and install alone. Some of these solutions may be using scraps of wood or whatever you may find around the job site, attached to a wall or ceiling, or propped against the wall or ceiling, but these solutions fail to meet the needs of the industry because they take time to create or build and are usually dangerous to work with. Other solutions may not allow the user to adjust the device to finalize the fit to existing conditions, but these solutions are similarly unable to meet the needs of the industry because in some instances homemade devices or other commercially made devices typically require installation only by screwing them to the studs which in some cases may not be appropriate, or even dangerous to the user. Still other solutions seek to use lumber to wedge materials to the ceiling which are not anchored or secured in any way which may not hold and if the home made solution fails it may cause damage to the materials or even injury to the person.

My system may be attached to the surface using wood screws or drywall screws. In addition has the option to use the saddle clamp to install it to the wall studs with out screws. Once it is installed to the studs the user can then lift the sheet and set it on the head of the device, then if the material is not touching the ceiling or is un level or other wise is not in the desired position the user may use the adjustment screw feature to help reposition the work piece. The device is a multiple use device which may also be used as a vice, or clamp. It becomes a holding or clamping system.

SUMMARY OF THE INVENTION

It is desirable to have a device that is versatile which/that is handy on the job site or around the shop. Furthermore, it would also be desirable to have a device that may reduce the need for several different tools. Still further, it would be desirable to have a device that is limited only by the imagination of the user. The disclosed device and associated methods advantageously fill these need and addresses the aforementioned deficiencies by providing a device that can act as a clamp, to hold items together while working on them, or that will hold items apart, and that will hold sheathing to a wall at various heights off the floor which normally requires two or more people. This system allows for a one man operation and assists with alignment to move the sheathing into the desired position while fastening or installing the sheathing to the wall. This device is designed to set up quickly and easily. Disclosed is a back saver support/clamp, which is made up of the following components consists of a back plate with holes for screwing to wood, threaded holes for mounting a saddle clamp, and threaded holes to attach pins for quick repositioning of the device.

A threaded body which is attached to the back plate, an adjustment screw which is threaded through the body, one end having a handle, the other end attached to a flat head with a swivel, the flat head may be called a "clamp head" which moves away from or closer to the body. Holes are drilled in the back plate and head plate to facilitate the attachment of accessories. This system is designed to work as a pair as follows' For sheathing or long materials such as plank siding or lumber may be mounted to a wall with screws or the saddle clamp each unit may be placed adjacent to each other facing upward with sufficient distance apart at a horizontal position from each other to allow for stable holding of sheets or long planks to material. Or for use as a clamp the units may be attached may be mounted with screws or optional saddle clamp facing opposite of each other to any flat surface or attached to the narrow side of dimensional lumber such as a 2"×4" to create an extra-long clamp at a desired distance apart from and either facing each other, The device may also have one or more of the following: a saddle clamp attached to the device which may be placed over a 2×4 on the narrow side with a knob or cam leaver & screw clamp to hold it without marring the wood. Also a different style handle may replace the sliding T handle if preferred. The tail end of the adjustment screw has a is machined with a ¼" or ⅜" hex head and Philips slots milled into the tail end, so the screw may be adjusted with a wrench, screw driver or an electric nut driver. An attachment which may be mounted on the clamp head to help prevent sheathing from slipping off the clamp head when used to support sheathing. 2 pins which screw to the hack plate into the body at 1 inch on center protruding opposite the body giving the user the option to drill a series of holes in wood or a work bench which would allow the user to quickly reposition the devices along the series of holes Similarly, the associated method may also include one or more of the following steps: The disclosed system is unique when compared with other known devices and solutions because it provides: (1) Secure attachment to work material; (2) adjustable for more accuracy and (3) safer to use. Similarly, the associated method is unique in that it: (1) may be used for other applications; (2) May be used in applications where drilling holes into the work is not desired.

The disclosed system is unique in that it is structurally different from other known devices or solutions. More specifically, the device is unique due to the presence of: (1) the adjustable lamp head; (2) The saddle clamp which reduces damage to materials the device is attached to (3) the removable drywall attachment so the device may be used for other applications And (4) The quick positioning pins located in the bottom (opposite of the body, or underside of the body) of the device to make it quicker to move from one position to another. (5) The system could include stops or back stops which could be used in conjunction with one of the units or devices which would allow the system to utilize the units as individual clamps. These stops could be designed to be mounted directly to a 2"×4" or other dimensional lumber, or may be mounted to a flat surface using common wood screws. The stop could be designed to either fit the existing saddle clamp or a saddle clamp could be designed specifically to fit the stop. Furthermore the stop could be designed to accommodate pins which would match up with the 1" on center holes drilled in series. This would give the system the option to use the units or devices as independent clamps.

Furthermore, the process associated with the aforementioned system is likewise unique. More specifically, the disclosed process owes its uniqueness to the fact that it: (1) may be used as a clamp when it is not needed as a holding device for sheathing; (2) The saddle clamps allows for quick attachment to the 2"×4" wall studs which allows for less "set up" reducing the time on the job, without damage to the studs; and (3) Has pins which can be screwed to the opposite (underside) side of the back plate which allows quick repositioning the device when using it as a shop clamp. (4) A template that can be used to drill ¼" holes spaced at 1" on center into material to facilitate the use of the pins that is provided with the system.(5) May be used at the job site with existing lumber as a clamp by attaching two units to the lumber with the heads facing each other and may be spaced at whatever distance is desired. (6) the units may be installed facing apart from each other to maintain an even spacing between materials. Or which may assist in straitening crooked or warped material. This disclosure will now provide a more detailed and specific description that will refer to the accompanying drawings. The drawings and specific descriptions of the drawings, as well as any specific or alternative embodiments discussed, are intended to be read in conjunction with the entirety of this disclosure. The Versatile holding, supporting, and clamping device may, however, be embodied in many different forms and should not be construed as being limited to the embodiments set forth herein; rather, these embodiments are provided by way of illustration only and so that this disclosure will be thorough, complete and fully convey understanding to those skilled in the art.

BRIEF DESCRIPTION OF THE DRAWINGS

FIG. 7: A diagram of the method of assembly of accessories depending upon the application the system will be used for.

DETAILED DESCRIPTION

Figure 1A:
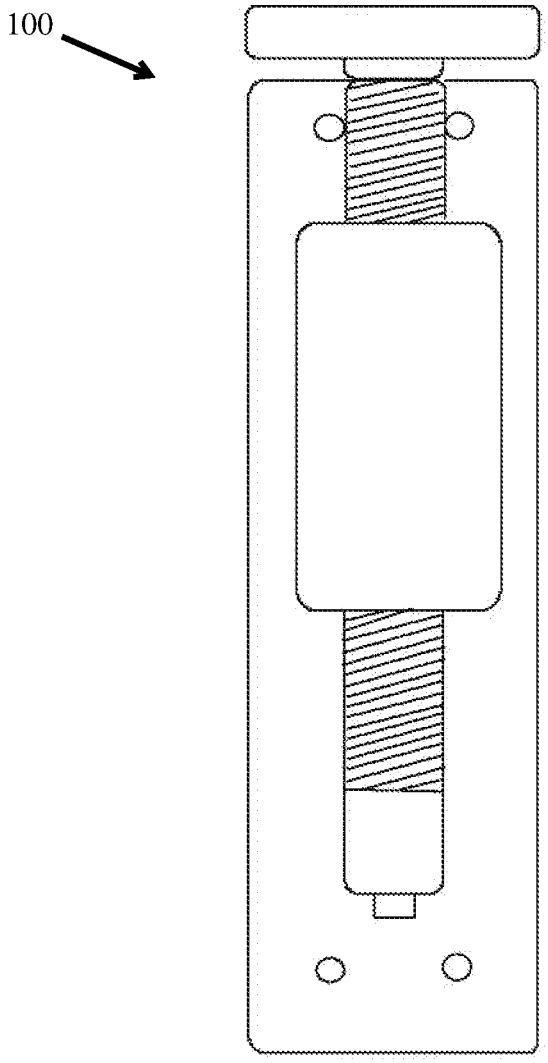
FIG. 1A: An overview of the system with a front (top) view.

The present invention is directed to holding, supporting and clamping tool. In its most complete form, the device is made up of the following components The base plate made of iron, aluminum or steel or of any material which is of sufficient strength to accomplish the intended use of the tool which is recommended to be 3/16 inch or ¼ inch thick with countersink holes for mounting the device to materials with screws, threaded holes for mounting accessories. A threaded body which may be made of iron, steel, aluminum or other suitable material which will support the tension when the device is under a load. A threaded adjustment bolt or screw with a machined ¼" or ⅜" hex nut, with Philips slots machined in the end at the tail and with a sliding removable handle through the tail end of the adjustment screw made of iron, steel or other suitable material to accommodate the tension when the device is under a load.

A clamp head made of iron, steel, aluminum or other suitable material to accommodate the weight or pressure when under a load recommended at least ¼" to ¾" thick depending upon the type of material is used to manufacture the tool which is attached with a swivel to the adjustment screw ½ inch diameter 5" long, made of iron, steel or other suitable material to accommodate the tension when the device is under a load. The threads may be machine, acme, course or other at the desire of the manufacturer or production company that makes and markets the product. The center of the clamp head should be at 1" from the surface of the work surface. The clamp head should be slightly smaller than 2 inches so the head does not scrape the work surface when being adjusted.

Accessories Include:

A saddle clamp which can be attached to the base plate to facilitate quick installation to the work with out marring the work, Pins which are screwed to the underside of the base plate as per diagram designed for quick repositioning when used in conjunction of a material with holes drilled at one inch on center. This could be a work bench, lumber, iron, aluminum or other material which the user chooses. A handle made of wood, polymer, plastic, iron, steel or other suitable material to accommodate the tension when the device is under a load which may be installed to the tail of the adjustment screw in place of the sliding handle, An attachment that can be mounted to the clamp head with counter sink screws for use with sheathing application to prevent sheathing from slipping off the head or to assist in mounting sheathing horizontal such as sheet rock being mounted to the ceiling, or other material which is needed to be mounted to a horizontal surface.

The face of the clamp surfaces or head surface which comes in contact with wood or other materials which may be being held, supported, or clamped are machined with a grid (similar to the surface on a framing hammer or which is common on other brands of vices or clamps) for additional grip of the wood or other material surface. It should further be noted that: The tool may be made all of Iron/steel or a combination of materials such as Iron, steel, aluminum, polymer, or other suitable materials to accommodate the tension or necessary strength when the device is under a load. If the body is made of material such as aluminum or polymer a steel or iron sleeve threaded to receive the adjustment bolt may need to be installed in the aluminum or polymer or other materials which may not be sufficient to work with the adjustment screw to prevent the adjustment screw from damaging the body or failing and causing injury to the user. Methods of tightening the adjustment screw may include a sliding T handle which is removable to accommodate using a nut driver, or wrench when using the ¼ or ⅜ hex end which is machined as part of the tail end of the adjustment screw which is also machined with Philips slots which gives the user the option to use a screw driver to operate the adjustment screw, or a handle which will fit over the tail end which will engage and snap on to the ¼ or ⅜ hex nut which is machined as part of the adjustment screw.

FIG. 1A Shows an overview of the device 100 which is multipurpose which can be used in several different ways and applications. FIG. 1 shows the view of the front (top) and overall concept of the device including components. The device could be made of all Iron parts, or a combination of Iron, Aluminum, composite, or other. Whichever works for the industry and the market.

Figure 1B:
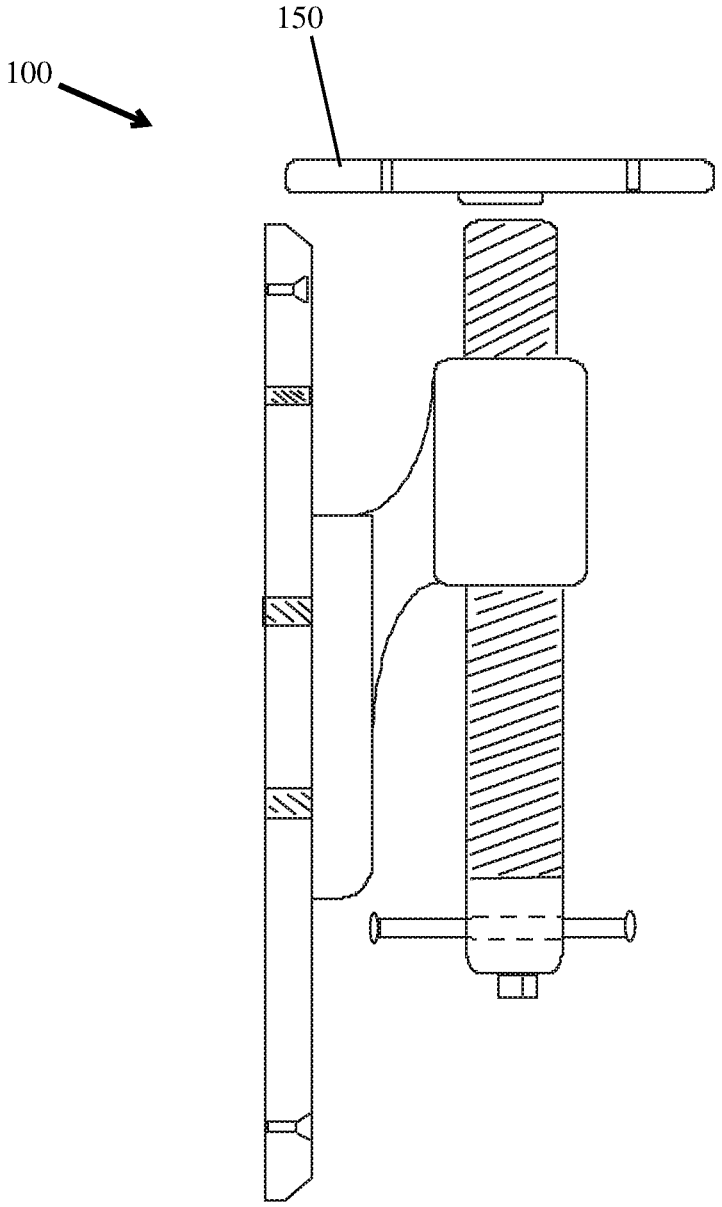
FIG. 1B: An overview of the system with a side view.

FIG. 1B Shows the same embodiment of the device 100 in FIG. 1A with a side view, not including the options or accessories. Accessories are in another FIG. following. The head plate 150 needs to be attached to the adjustment screw with a swivel or pivot to allow the screw turning with out turning the head which will be very close to the material it is attached to. The device is limited only by the imagination of the user.

Figure 2:
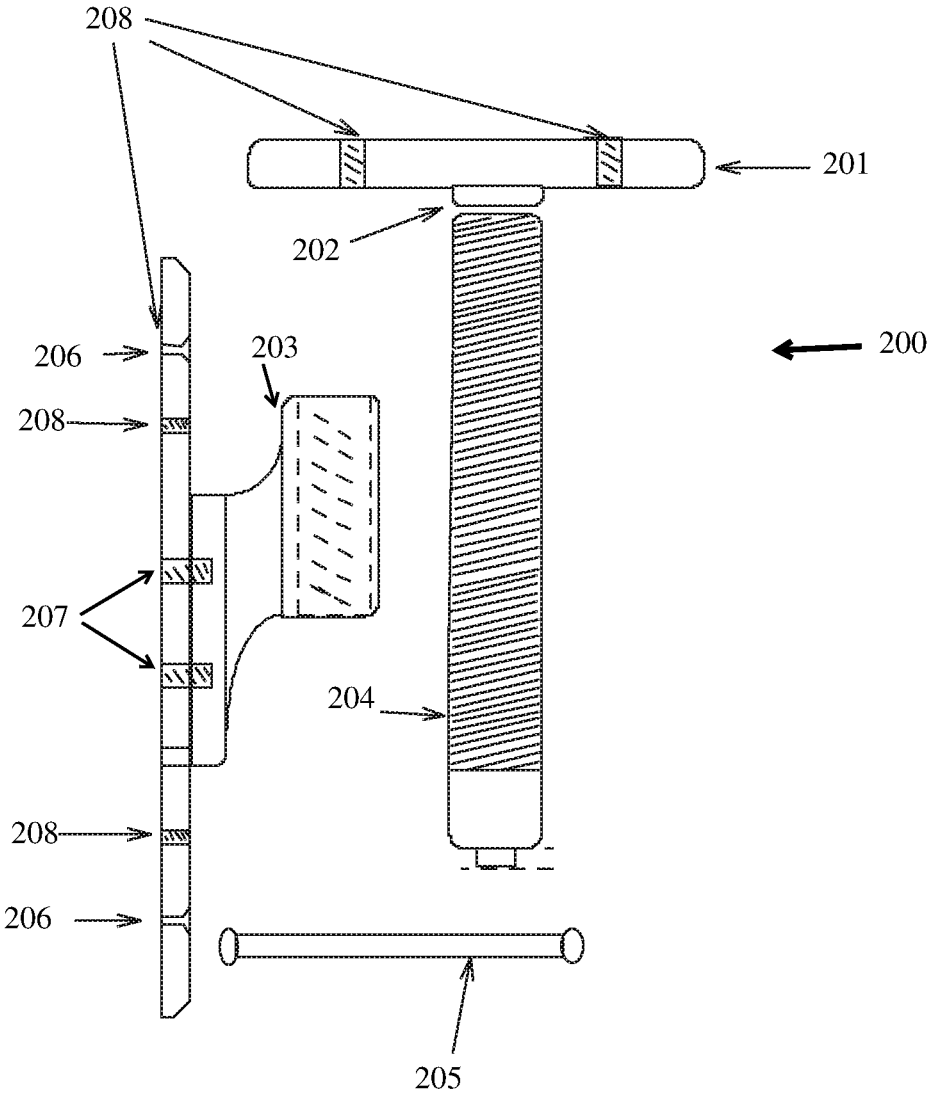
FIG. 2: Side view with A list of parts with numbers associated with a name for each part or function.

FIG. 2 shows a side view of the components with numbers and matching names or descriptions. Clamp Head 201 with counter sink screw holes connects atop a swivel 202. The swivel connects to an adjustment screw 204. One shown component is a handle for the adjustment screw 205. Another shown component is a threaded nut block, also known as body or device body, 203 with a threaded bore adapted to receive the adjustment screw therethrough. Another component shown is a wall plate 206, also referred to as a wall back plate in this patent application, with countersink screw holes. Further shown components are holes 208 to mount accessories or non-mar material. Additional components are threaded holes 207 adapted to receive work bench pins, shown spaced 1" on center.

Figure 3:
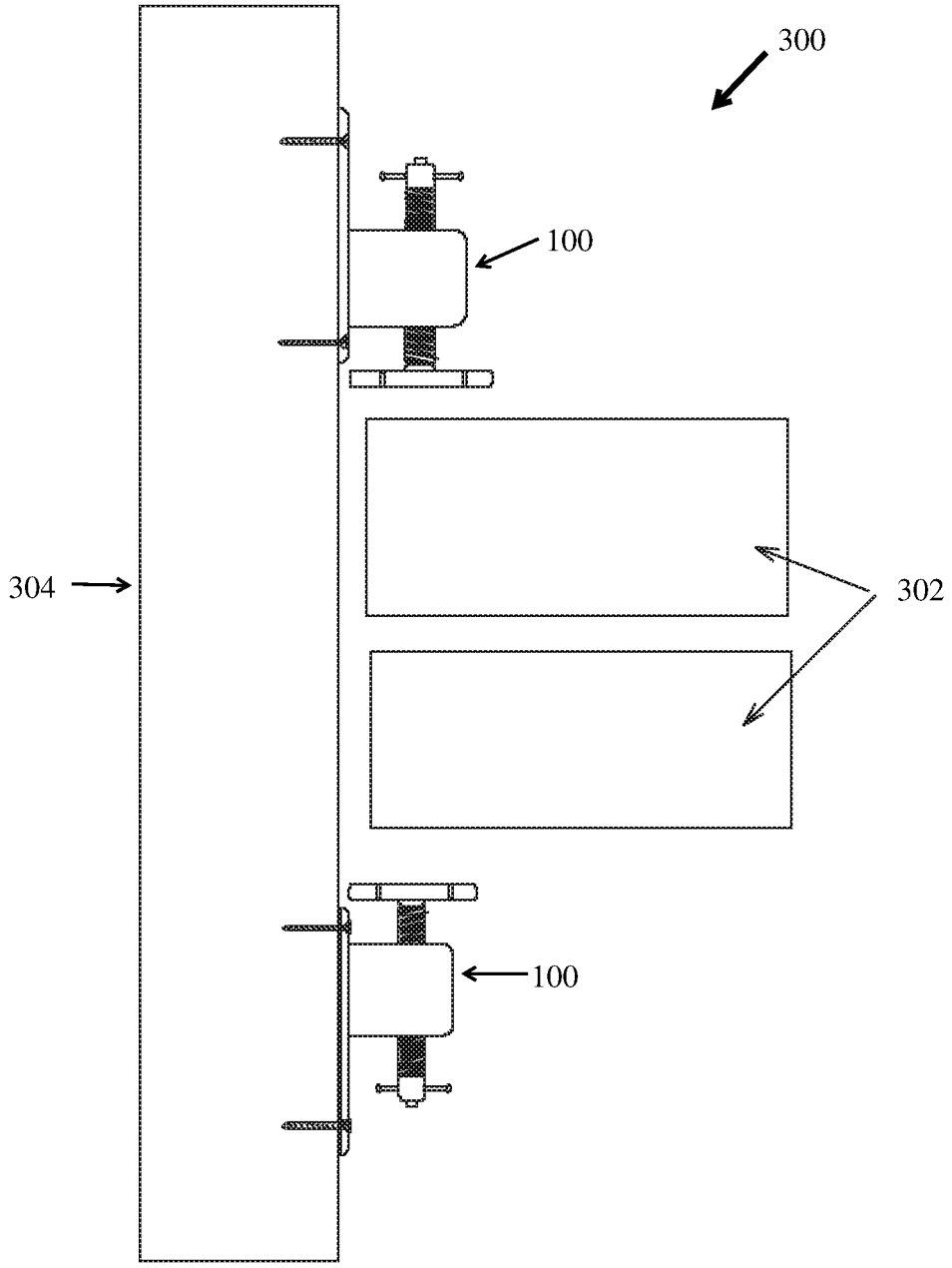
FIG. 3: An application diagram to illustrate the use as a 2×4 clamp.

FIG. 3 shows items to be clamped together 302. Using a pair of the devices (recommended to be sold as a pair) can be mounted either with screws through holes provided in the base plate or with the saddle clamp which mounts to the base plate to threaded holes positioned to the back plate which can then be mounted to the to a 2×4 piece of lumber at what ever the desired distance and becomes a vice or clamp. The device could also be mounted to Iron, aluminum or other substance by simply drilling and tapping holes to fit common ¼ inch screws or bolts.

Figure 4:
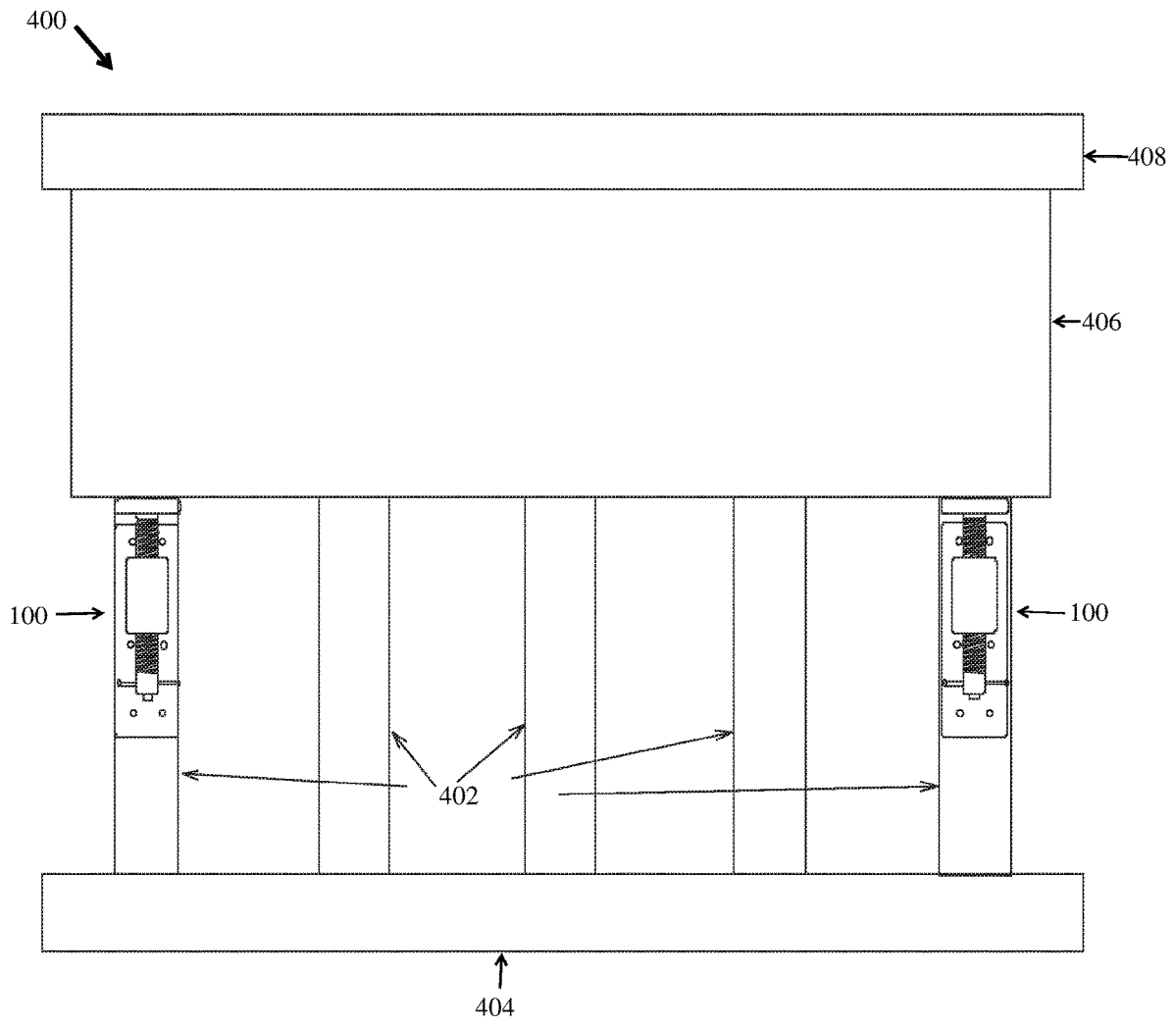
FIG. 4: An application diagram to illustrate the use for a holding device which is attached to 2×4 studs at a height above the floor to hold materials to assist in attachment of the materials to a wall.

FIG. 4 shows a sheathing application 400 wall studs 402 connecting a stud wall bottom plate 404 and a stud wall top plate 408. 406 is sheathing, drywall, plywood, siding, or similar, and is held up by the devices 100. For one person attaching sheets of construction material to the upper portion of a wall without help can be difficult to hold while installing nails or screws. Using this device allows a person to set the sheet on the heads of the device to support the sheet while the installer can install enough nails or screws in the sheet to hold it. The devices may then be moved to the next section of the wall in preparation for the next sheet. Sheathing is often required to be tight to the ceiling, the adjustment screws allow for adjusting the sheath once it is supported by the device which free's up a hand.

This is what started the idea. I am a building and remodeling contractor, often I am working alone. While working in a house putting up sheet rock I found that I couldn't lift the sheets to the ceiling and hold it with both hands and still hold screws and a screw gun all at the same time, I had to have a helper. This is a device to hold sheathing at distances off the floor to a wall while it is being attached, this makes it possible or easier for one person to move sheets of material into the exact place be wants it. Then using a screw gun it can be secured to the wall. The adjustment screws make it possible to fine tune the position of the sheathing so it fits exactly where it is wanted.

Figure 5:
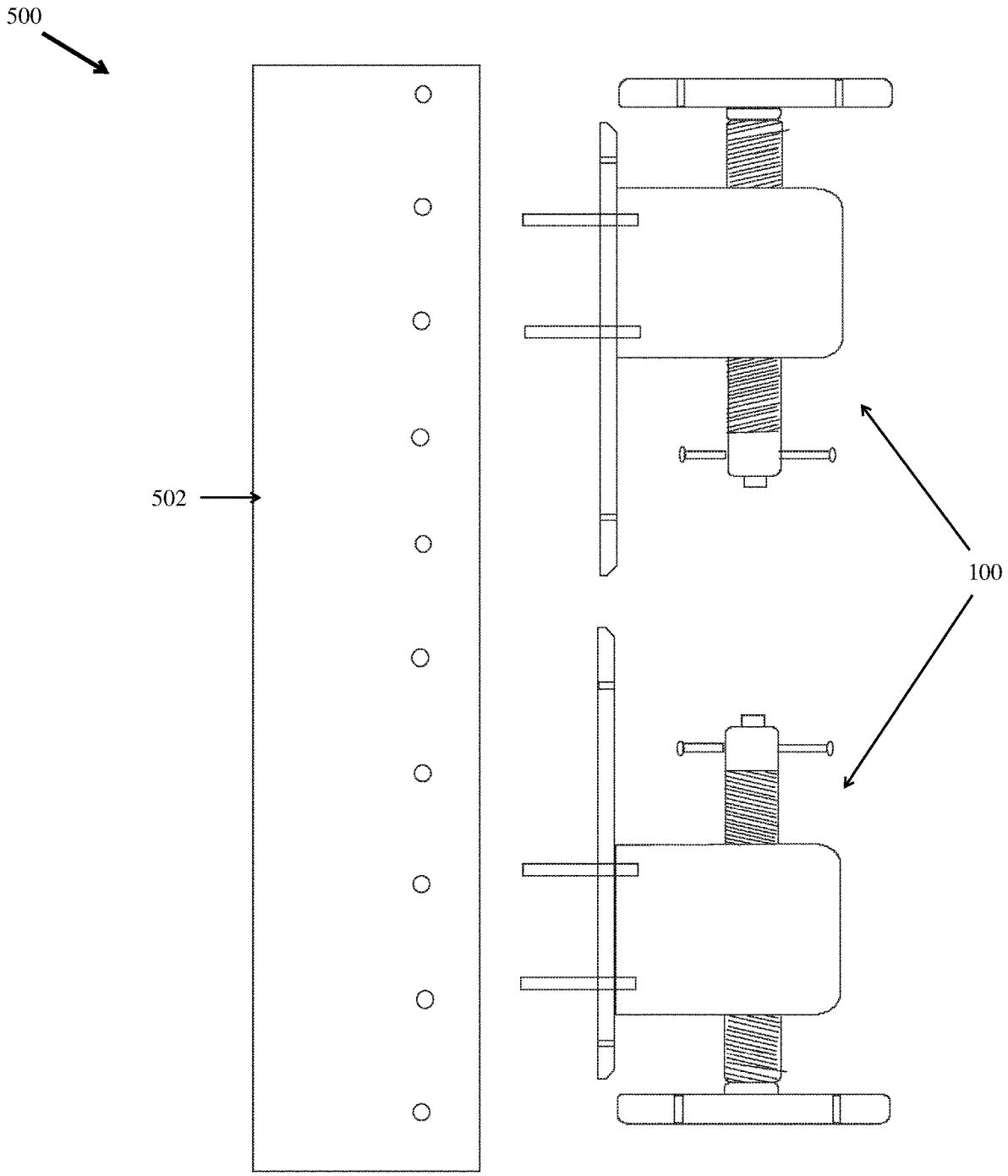
FIG. 5: An application when the units may be used to hold or push materials away from each other.

FIG. 5 is a spreader application. Work bench 502 receives devices 100. The devices may be placed facing in opposite directions between two objects to push the objects apart from each other. As my imagination started working I realized that often there are times when objects need to be spaced and held apart from each other. I realized that these could be turned around and become a spreader or a device to hold materials apart at exactly the correct desired space or may assist in straightening warped or bent materials.

Figure 6:
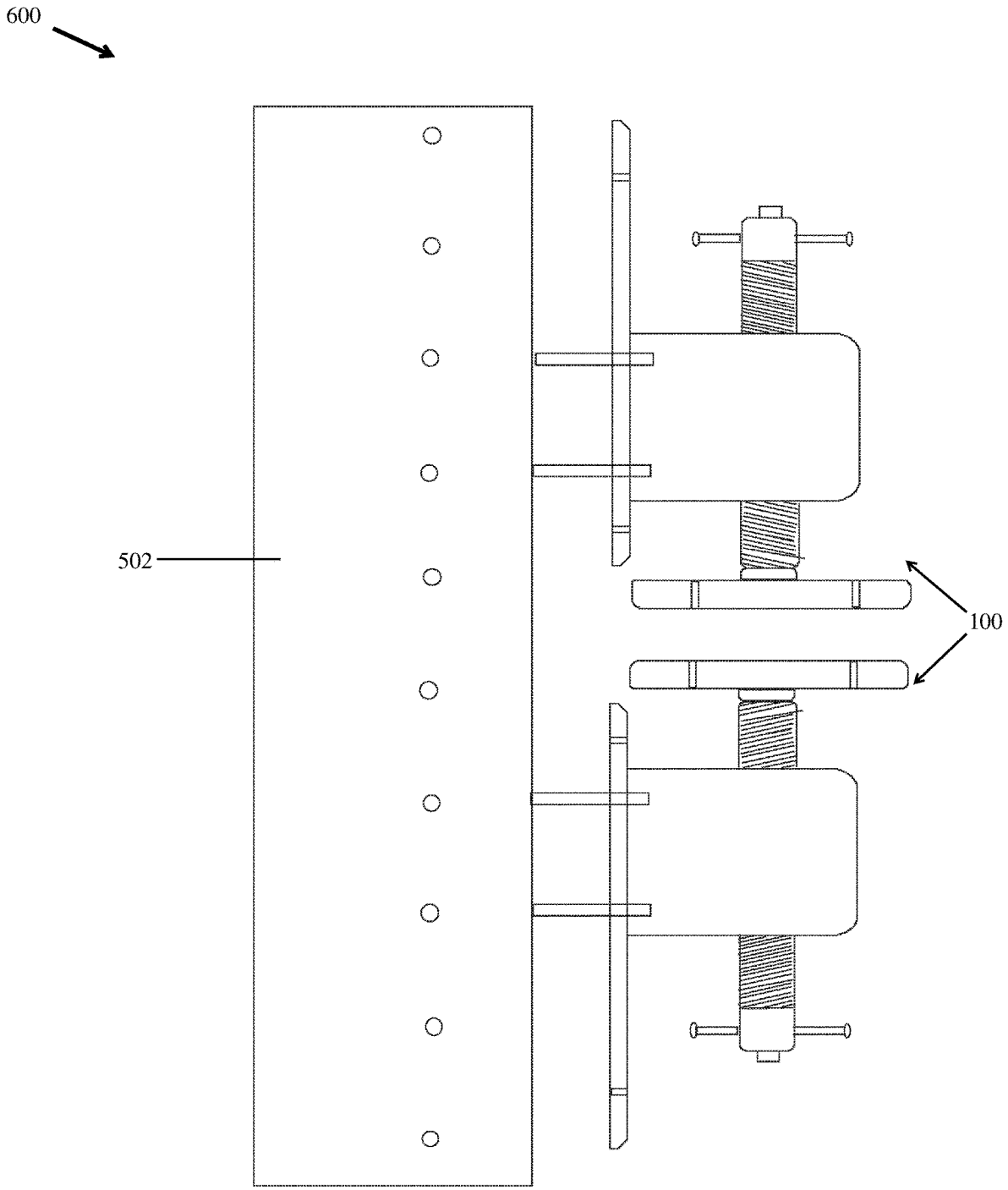
FIG. 6: An application when the units may be used in conjunction with holes drilled in a work bench or other material to be used a clamp which the units can be simply lifted from the surface at one position and placed at another with the pins in the units that fit into the pre drilled holes.

FIG. 6 shows a work bench application 600. Devices 100 are again received by work bench 502. Holes may be drilled in a work bench or any surface desired at, for example, 1" on center intervals. The device with removable pins installed can be placed with pins in the holes. This allows the device to be moved easily and quickly. It would be handy to be able to just lift the device or devices and reposition them without having to install screws every time. So, I put pins that are screwed into the underside of the base plate at 1 inch on center, then drills in a work bench, 2×4 lumber other material that matched the pins. The device could quickly be moved along the series of holes to clamp or spread materials.

Figure 7:
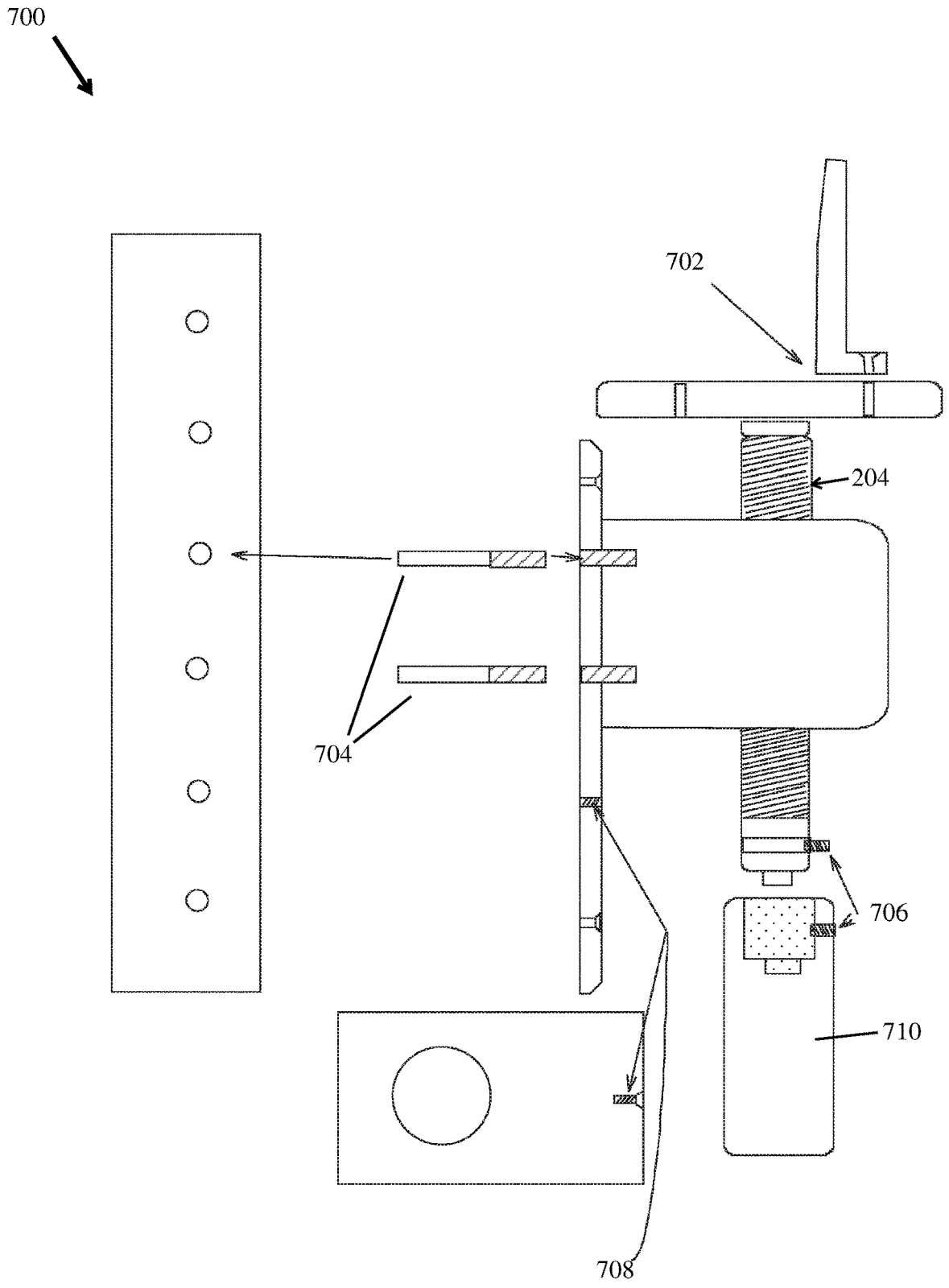

FIG. 7 shows an assembly and usage description. Suggested assembly of the unit accessories, and where the accessories are to be placed. Set screw 706 is placed in the optional handle 710 and helps connect it below the adjustment screw 204. To use the optional handle remove the sliding handle then slide the optional handle over the tail end of the adjustment screw. Tighten the handle set screw.

At 708, to mount Saddle clamp to the device slide the clamp over the device mounting plate and install screws in the threaded holes. NOTE: The revised device places the Saddle clamp in front of the device body. For work bench application install pins into the device body. The device is then ready to send pins into the series of holes in the work bench or other board with holes prepared at 1" on center.

Figure 8:
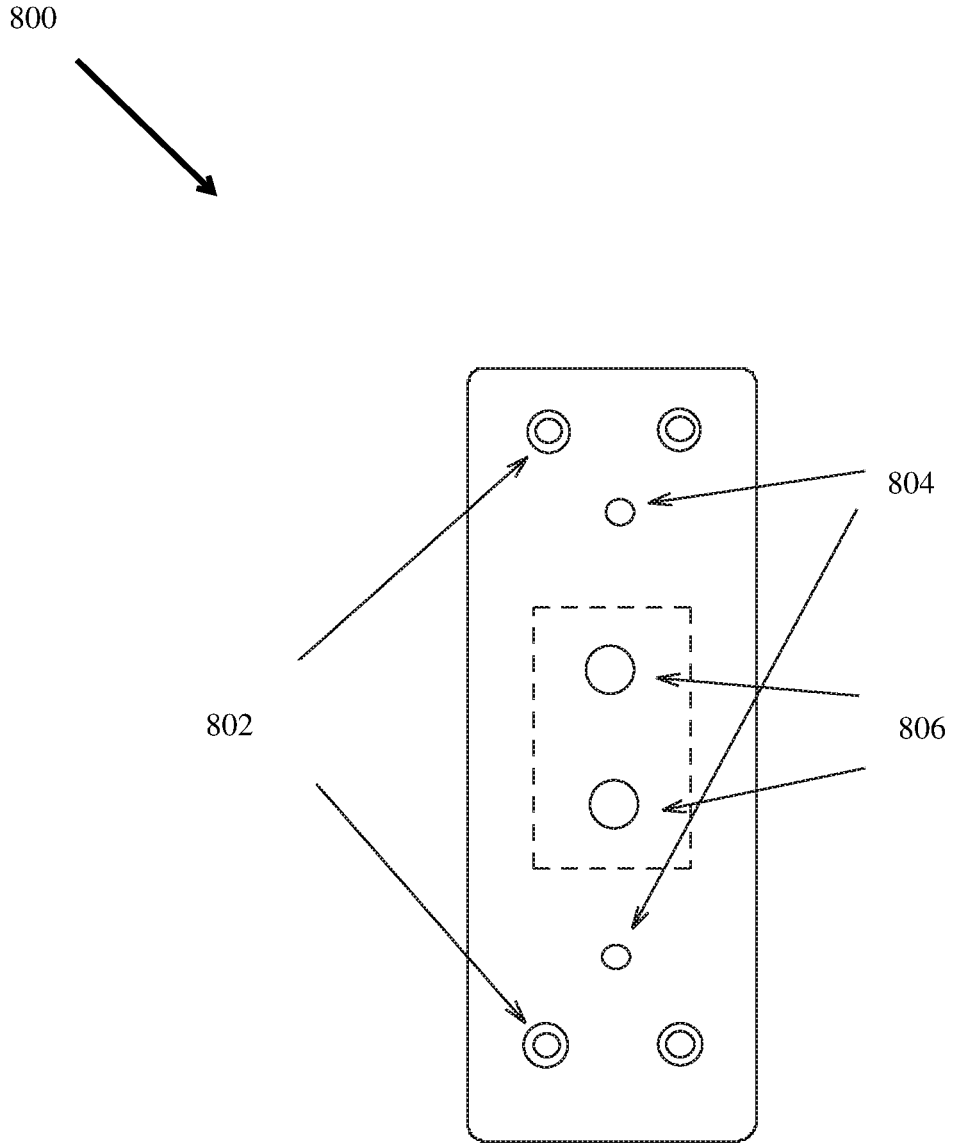
FIG. 8: An updated diagram of the base wall mounting plate.

FIG. 8 shows a wall mounting base plate and describes how the hole positions and purpose in base plate is designed to mount to the surface or the accessories. There are two threaded holes 806 for mounting quick release saddle clamp used to mount to a 2×4 so the device may be attached and released quickly for quick repositioning. Threaded holes ¼" on center to insert quick movement pins for use when inserting into predrilled holes in a flat surface, such as a work bench, 2×4, or bar with holes drilled at 1 inch on center. Further, there are two threaded holes, 804, for mounting quick release saddle clamp used to mount to a 2×4 so the device may be attached and released quickly for quick repositioning. It also shows four countersink holes 802 to facilitate mounting to a surface using wood screws.

Figure 9:
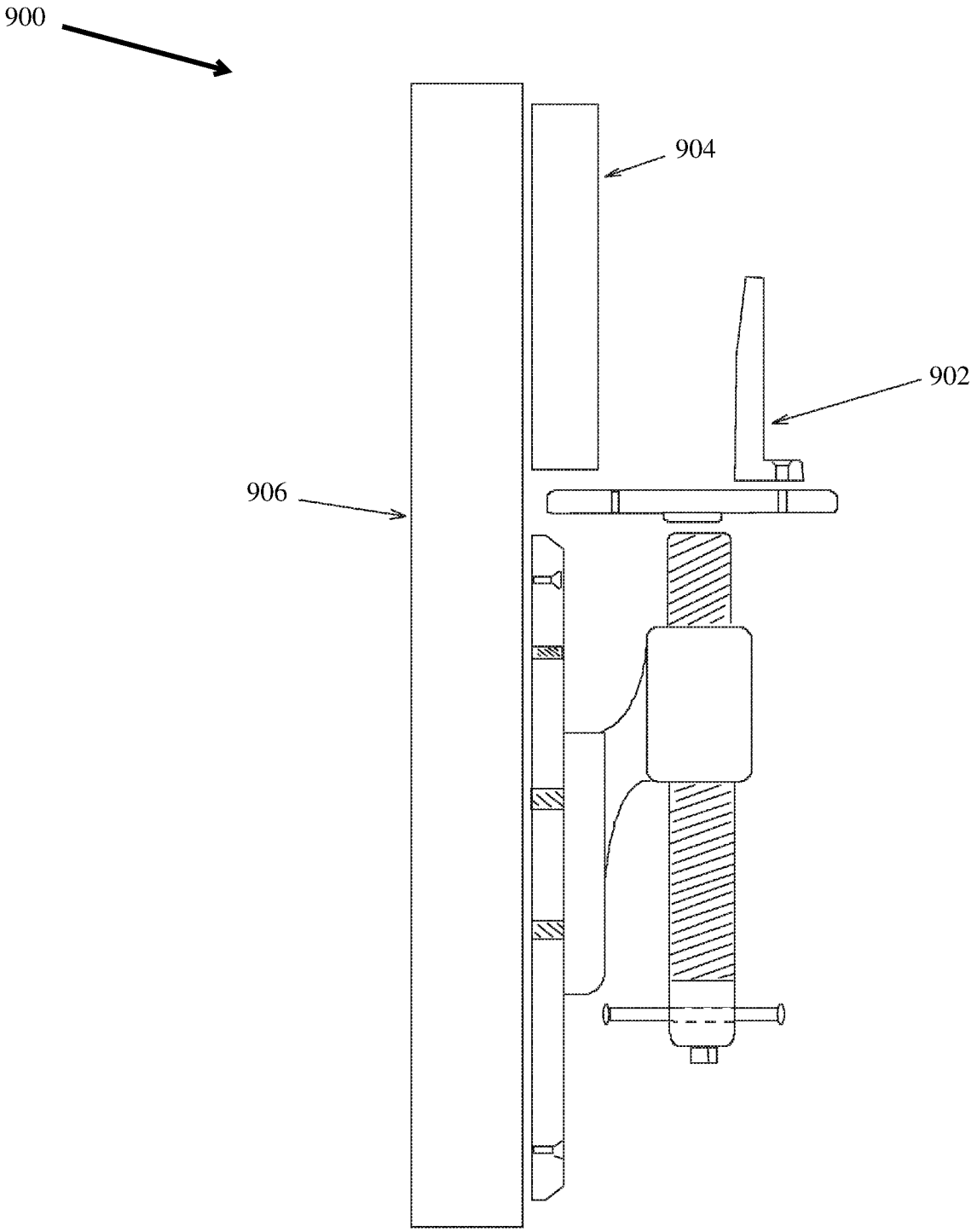
FIG. 9: Drywall attachment installation and application

FIG. 9 is an overview diagram of a redesigned, tool which may improve functionality of the tool from the original design and shows the drywall attachment installation and application. Drywall accessories 902 may be used to support drywall or other sheathing 904 while installing to a wall 906, ceiling, or other horizontal surface. Shows the drywall attachment installation and application.

Figure 10:
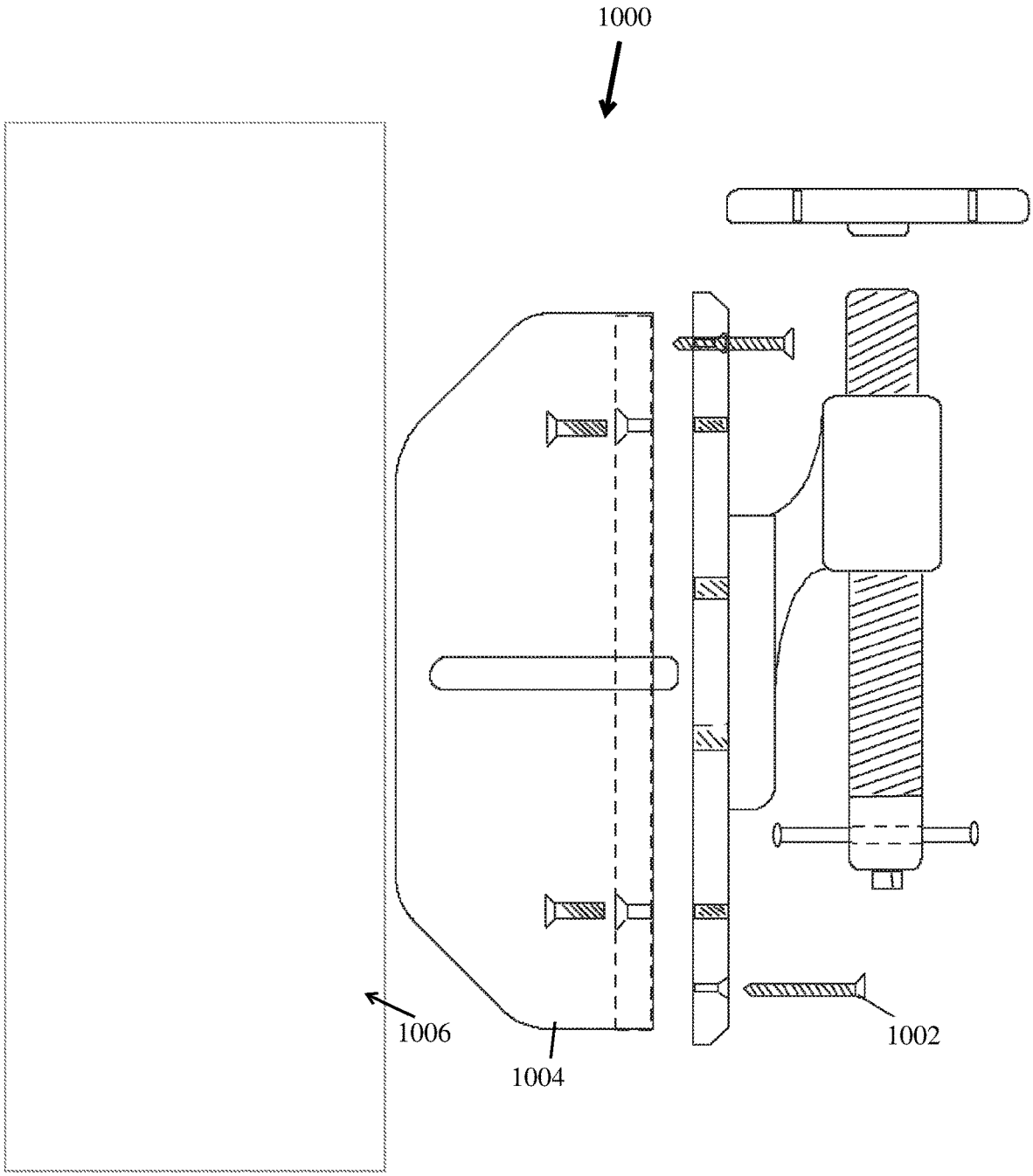
FIG. 10: Installation and application of Saddle clamp.

FIG. 10 shows the saddle clamp how it is intended to mount to the tool then to the work which would be the narrow edge of lumber which is 1½ inch thick, and the clamp and know incorporated into one side of the saddle clamp for quick repositioning. The tool with the saddle clamp may also work in conjunction with screws in order to give additional strength for when the tool is need for more clamping pressure. Wood screw 1002 is for mounting directly to surface 1006 (such as 2×4 lumber). Saddle clamp 1004 is shown in a lumber mounting application.

Figure 11:
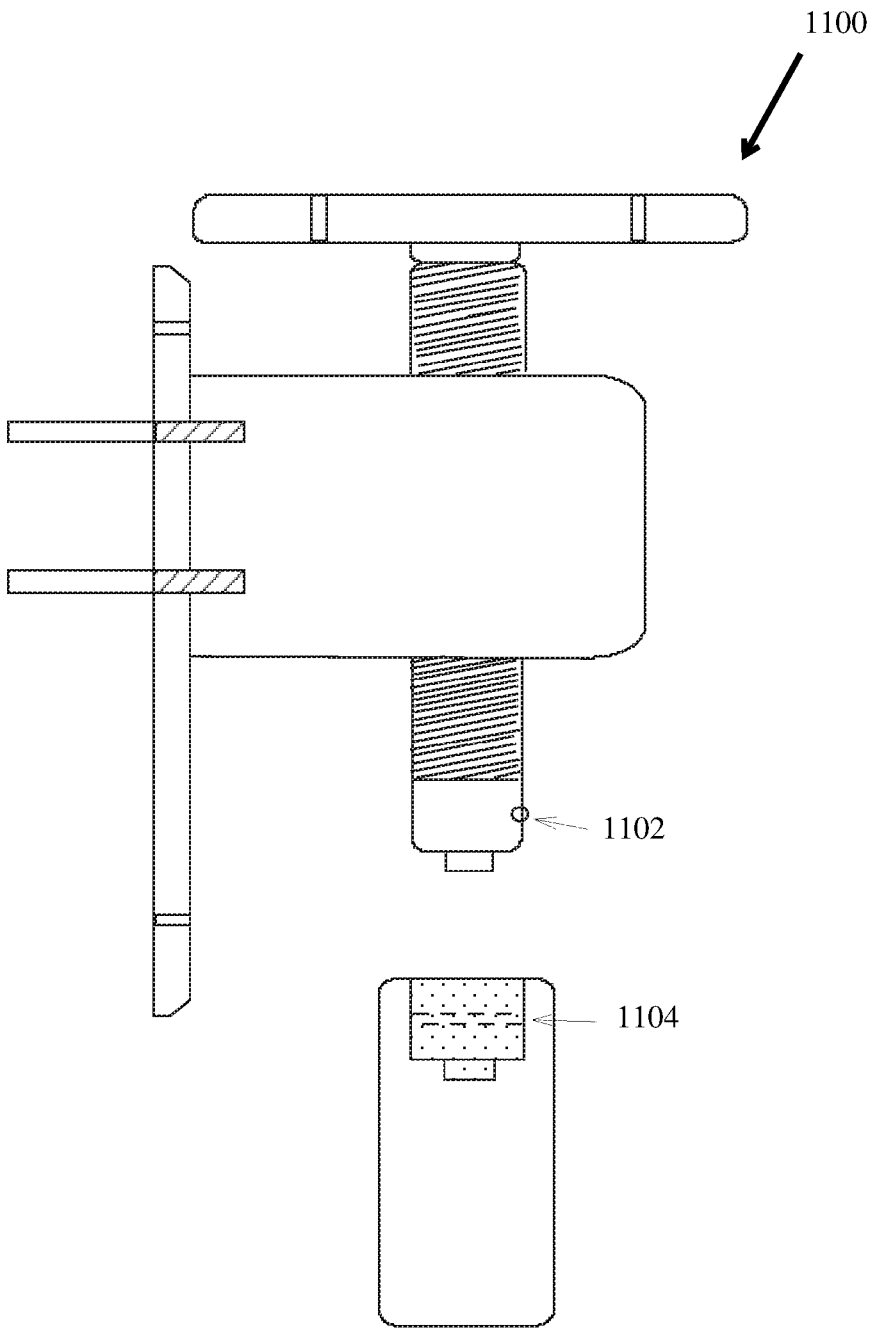
FIG. 11: Snap on handle diagram and operation.

FIG. 11 shows a snap on handle operation. This shows a hand-held handle rather than the sliding T style. The handle may be removed so a wrench may be used alternately. The hex nut also has Philips slots in the tail end which will accommodate a screw driver or drill/driver. being able to remove the handle may be handy in tight spaces, the adjustment screw could then be turned with a wrench. A drill/driver could be used to speed up the operation. The tail of the adjustment screw has a hex nut machined into the tail. The tail part where the handle slides over the adjustment screw has a spring-loaded ball catch which matches up with a ring inside the receiver of the handle. The hex nut fits into a female hex shaped receiver for the nut. The nut has a Philips slot to accommodate a screw driver. Ball catch 1102 fits into the groove for ball catch 1104.

Figure 12:
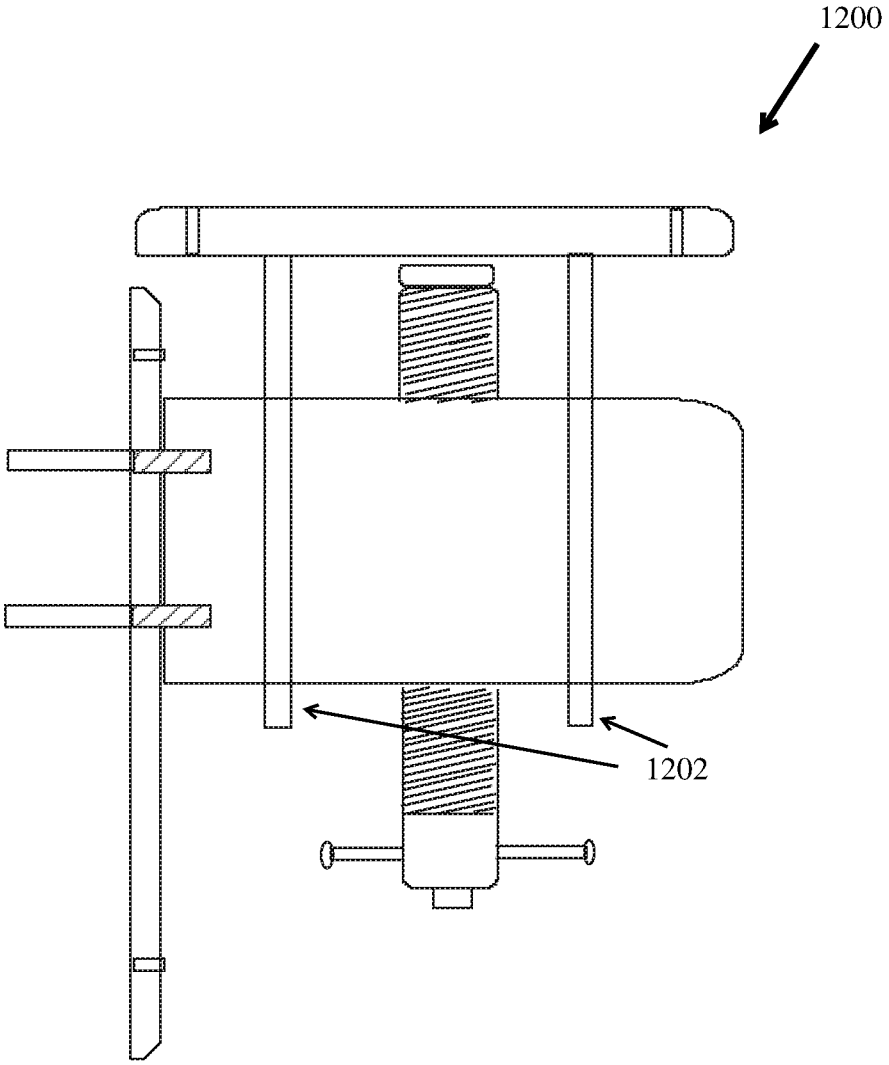
FIG. 12: Anti pivot pins illustration.

FIG. 12 illustrates anti-pivot pins from a side view of the device. Some applications may require the clamp head to be stationary and not be able to pivot or spin. This diagram shows pins or bars installed in the tool to prevent pivoting or spinning of the clamp head and offer more secure holding, supporting, or clamping. Pins or bars 1202 slide through the body to prevent the head from pivoting.

Figure 13:
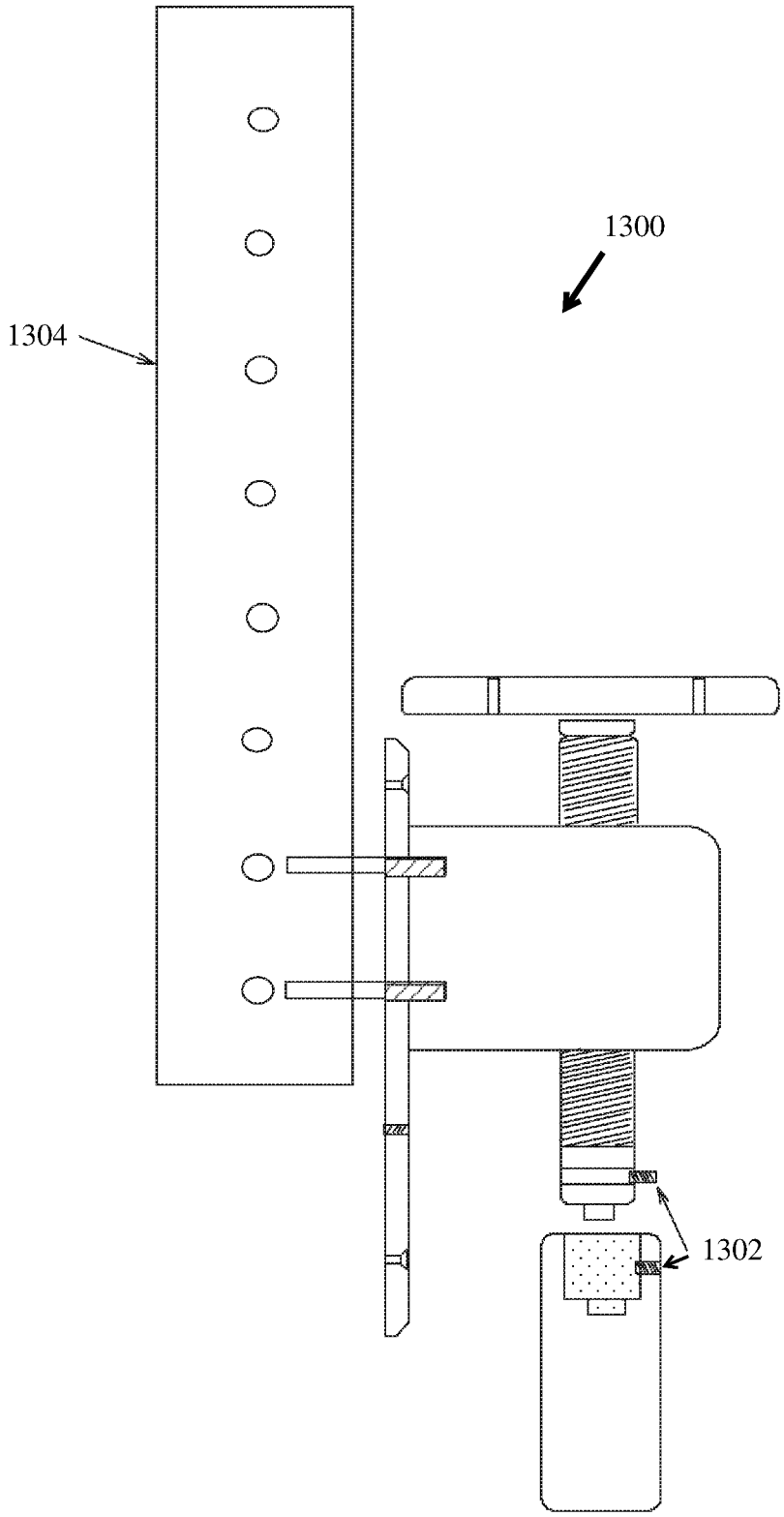
FIG. 13: Diagram of template for drillings holes in work bench or other stock so the unit can be used with the repositioning pins which are mounted to the underside of the base plate.

FIG. 13 illustrates a template for drilling holes on which to place the device with pins installed. It is a template for the user to be able to drill a series of holes at, for example, exactly 1 inch on center. This should be made of a reusable material which is ⅛ to ¼ inch thick such as Iron, Aluminum, Plastic or other material which would be able to be used over and over. For the template application, install the pins into the device body. Draw a line on the surface to be drilled of the desired length of the planned quick clamp. Place the template at the beginning lined with the line you have just drawn. Drill holes with the template, then place the device in the first two holes, position the device in through the template and into the last two holes, drill holes using the available holes in the template. Repeat the process until the desired length is accomplished. 1302 shows the set screw for the handle. 1304 shows a template with 8 holes at 1" on center.

Figure 14:
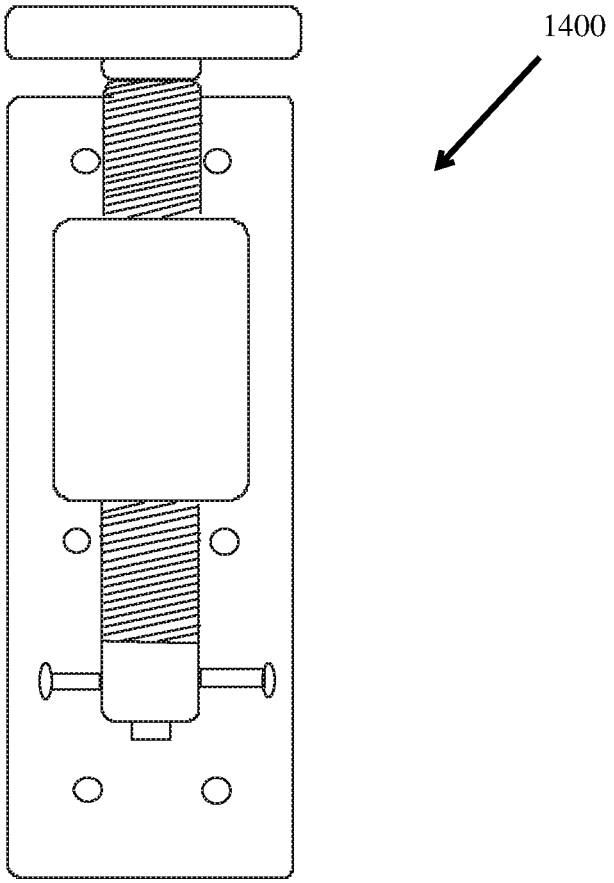
FIG. 14: Top view of original design.

FIG. 14 shows a version 1400 of the original design. Improvements and designs have been added. This is included to show alternate designs.

Figure 15:
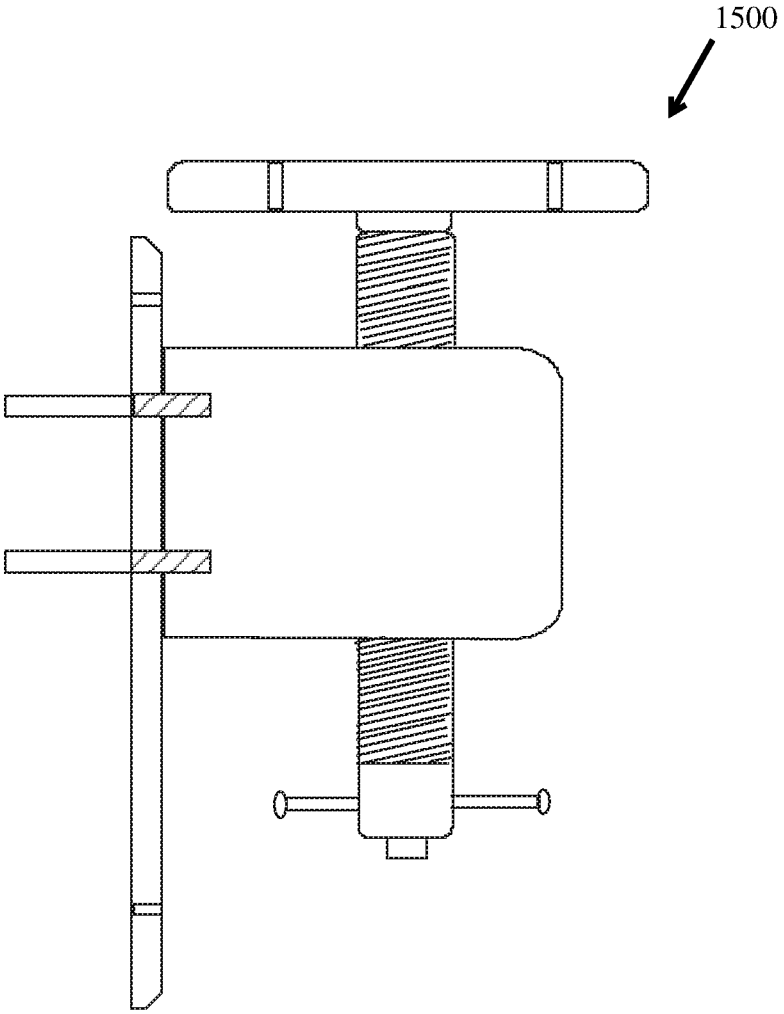
FIG. 15: Side view of original design.

FIG. 15 shows another version 1500 of the original design. Improvements and designs have been added. This is included to show alternate designs.

Figure 16:
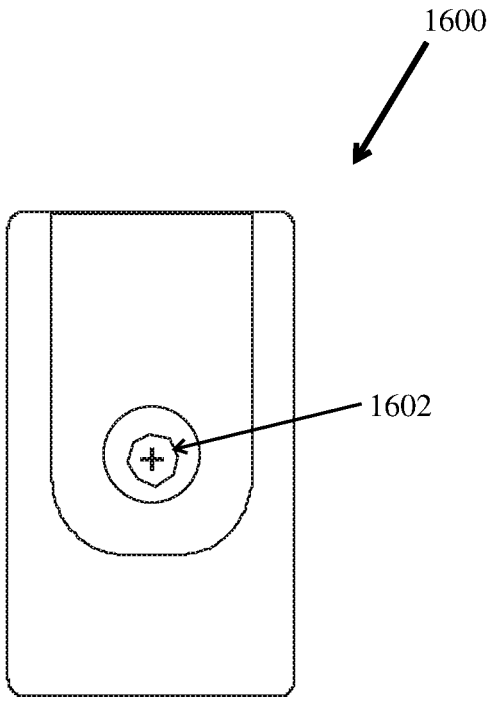
FIG. 16: Bottom view of the end of the adjustment screw in the threaded nut block

FIG. 16 shows another version 1600 of the original design. Improvements and designs have been added. This is included to show alternate designs. 1602 is the end of the adjustment screw, a hex nut or hex head, machined as part of the adjustment screw to match the socket end of the removable handle. It may include a Philips slot to accommodate a Philips screw driver or Philips driver bit.

Figure 17:
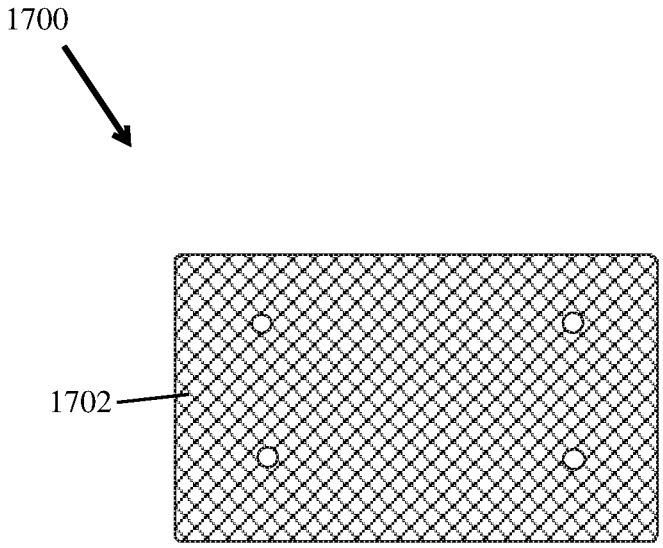
FIG. 17: View of clamp surface design

FIG. 17 shows that All Clamp surfaces which contact surfaces being mounted to or contact materials being held in place should be grided 1702, or have a removable part which will grip the surface without damage.

Figure 18A:
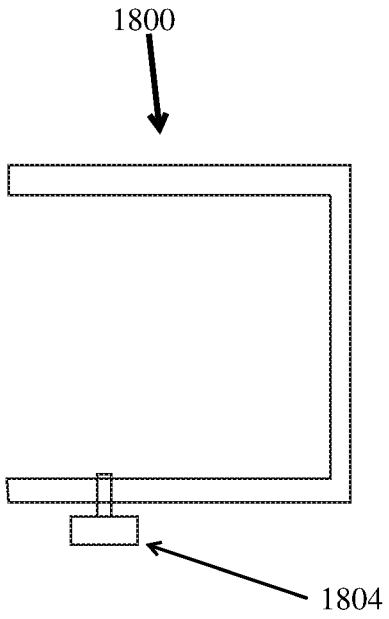
FIG. 18A: Side view of a saddle clamp embodiment with a knob handle design

FIG. 18A shows one embodiment of the saddle clamp. 1804 is a knob clamp.

Figure 18B:
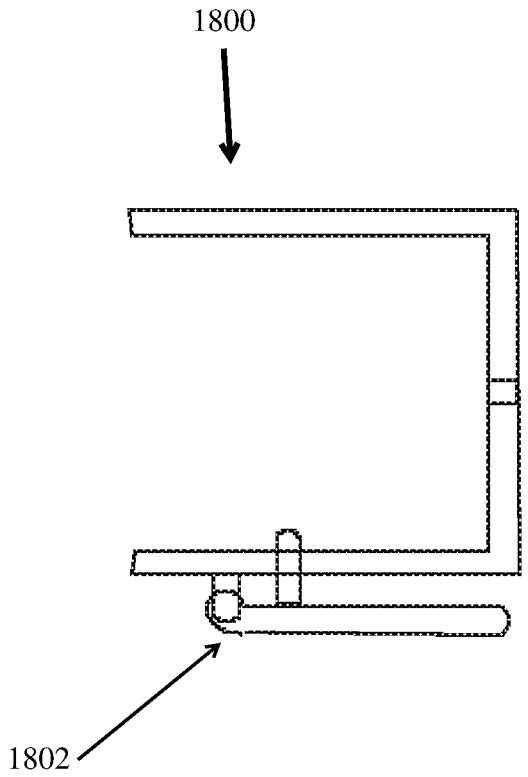
FIG. 18B: Side view of a saddle clamp embodiment with a cam lock lever design

FIG. 18B shows a second embodiment of the saddle clamp attachment. This embodiment functions with a cam leaver/lock handle.

In general, a professionally manufactured tool may be fine-tuned for functionality or prospective user appeal. Or to match the manufacturer or marketing companies scheme and marketing practices. There is another option in style which may be more attractive for marketing and also may be lighter. This may be a unit with the center of the clamp head at 1½ inches from the work surface. The function would be the same. A larger size may be desirable for many applications. The tool may be manufactured at various sizes.

The devices may also be attached a 2"×4" board or other dimensional board to turn lumber into a versatile clamp, or attached to a work bench to use a portion of a workbench to clamp, hold, or support materials.

The core components of the invention are: a mounting base plate, screw body, adjustment screw, clamping head, saddle clamp, drywall attachment and removable pins which, generally speaking, are configured as follows: The mounting base plate is attached to the wall, lumber, workbench or other materials with common wood screws or drywall screws, the screw body is the part which is drilled and threaded to receive the adjustment screw which is attached to the clamping head via a swivel.

With respect to the system it should be further noted that The system includes accessories such as a saddle clamp which allows attaching to a 2"×4" lumber with out marring or making screw holes, an accessory part that can attach to the clamp head which prevents sheathing from slipping off the clamp head, and two types of removable handles. With the handles removed there is a hex nut machined in the tail of the adjustment screw and phillips slots milled in to the tail of the adjustment screw allowing for use with a nut driver or a screw driver.

With respect to the associated method, In order to carry out the method the following core steps are followed: For sheathing support attach 2 of the devices to vertical studs, set the sheathing on the clamping heads, use the adjustment screw to level or fine position the materials.

The system may be attached to a board (lumber) 2 devices at any distance facing each other desired to accommodate the materials to be clamped. Or the devices may be mounted facing away from each other to spread or hold materials a specific distance apart from each other.

The devices may be mounted on a work bench either with screws, or the removable pins may be installed in the underside of the mounting plate in threaded holes spaced 1 inch on center which corresponding to a series of holes which may be drilled in the work bench or lumber or other surface at 1" intervals in a straight line and may be quickly positioned simply by lifting the device out of the holes and moved to a closer or farther position along the series of holes to each other.

The system includes a template to assist the user in drilling a series of holes usually in wood such as a work bench or lumber to be used with the pins which are installed in each of the two device.

Ultimately, at the conclusion of these steps allows one person operation in many instances where otherwise more than one person would be required and or more convenience generally.

Different features, variations and multiple different embodiments have been shown and described with various details. What has been described in this application at times in terms of specific embodiments is done for illustrative purposes only and without the intent to limit or suggest that what has been conceived is only one particular embodiment or specific embodiments. It is to be understood that this disclosure is not limited to any single specific embodiments or enumerated variations. Many modifications, variations and other embodiments will come to mind of those skilled in the art, and which are intended to be and are in fact covered by both this disclosure. It is indeed intended that the scope of this disclosure should be determined by a proper legal interpretation and construction of the disclosure, including equivalents, as understood by those of skill in the art relying upon the complete disclosure present at the time of filing.

Additional Information

As with any mechanical device if the device Is used incorrectly or abused it may be dangerous to the user or others who may be in the vicinity.

The invention claimed is:

1. A system for holding, supporting, and/or clamping, comprising:

a wall back plate, said wall back plate having an upper surface and a lower surface, four countersunk mounting holes and two threaded holes, each of said two threaded holes configured to receive a work bench pin;

a block attached to said upper surface of said wall back plate, said block having a base portion having a first threaded portion and a second threaded portion extending into and terminating within said block, whereby a first said work bench pin is threaded through a first one of said two threaded holes and into said first threaded portion, and a second said work bench pin is threaded through a second one of said two threaded holes and into said second threaded portion, said block further having a threaded bore extending substantially parallel to said upper surface of said wall back plate; and an adjustment screw threaded through said threaded bore, said adjustment screw having a first end and a second end opposite said first end;

said adjustment screw further having a handle extending through a portion proximate said first end of said adjustment screw, a hex head shaped portion at said first end, a swivel having a first side attached to said second end of said adjustment screw and a clamp head attached to a second side of said adjustment screw.

2. The system of claim 1, further comprising:

a saddle clamp attached to said lower surface of said wall back plate which allows for attachment to wall studs.

3. The saddle clamp of claim 2, further comprising: a knob handle or a cam lock lever, said cam lock lever configured to affix and release said saddle clamp from said wall studs.

4. The system of claim 1, further comprising:

an L-shaped accessory configured to support a sheathing or horizontal surface during installation, said L-shaped accessory being secured to said clamp head, wherein:

said L-shaped accessory is configured such that, during installation, a user may slip one edge of said sheathing onto one or more of said systems equipped with said L-shaped accessory.

5. The system of claim 1, further comprising:

a template, into which a series of holes are drilled, which can be used by a user to accurately drill additional holes along a surface which will allow for insertion of respective said pins by a first end of each said pins, a second end opposite said first end of each of said pins traveling through an underside of the wall back plate.

* * * * *